US008624142B2

(12) United States Patent
Mathew et al.

(10) Patent No.: US 8,624,142 B2
(45) Date of Patent: Jan. 7, 2014

(54) ELECTRICAL DEVICE CONTROLLER HAVING A SWITCH AND A THUMBWHEEL DIMMER

(75) Inventors: Renjith Mathew, New Hyde Park, NY (US); Walter Ancipiuk, Staten Island, NY (US); Yun Wu, Bayside, NY (US); Alfred J. Lombardi, Syosset, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 13/404,772

(22) Filed: Feb. 24, 2012

(65) Prior Publication Data

US 2012/0152707 A1 Jun. 21, 2012

Related U.S. Application Data

(63) Continuation of application No. 12/354,420, filed on Jan. 15, 2009, now Pat. No. 8,124,898.

(51) Int. Cl.
*H01H 3/00* (2006.01)

(52) U.S. Cl.
USPC ..... 200/329; 200/18; 200/330; 200/339

(58) Field of Classification Search
USPC ..... 174/66, 67; 307/112, 125, 139–141, 307/157; 323/905; 338/153, 176, 197, 199; 362/27, 85, 555; 200/330, 331, 1 B, 200/17 R, 339, 18, 556, 553, 332
See application file for complete search history.

(56) References Cited

U.S. PATENT DOCUMENTS

| | | | | |
|---|---|---|---|---|
| 7,365,282 | B2 * | 4/2008 | Altonen et al. | 200/331 |
| 8,124,898 | B2 * | 2/2012 | Mathew et al. | 200/330 |
| 2006/0108208 | A1 * | 5/2006 | Ilkhanov | 200/18 |

* cited by examiner

*Primary Examiner* — Renee S Luebke
*Assistant Examiner* — Ahmed Saeed
(74) *Attorney, Agent, or Firm* — Carter, DeLuca, Farrell & Schmidt LLP

(57) ABSTRACT

An electrical device controller is provided for controlling power to a load. The controller includes a housing having an open face and a plate having a unitary aperture secured to the housing and disposed over the open face. The controller further includes an electrical power controller component positioned within the housing for coupling to a power source and a load, a first actuator coupled to the electrical component, and an adjacent second actuator coupled to the electrical component. The first actuator has a movable user operable portion that is user accessible via the unitary aperture for controlling power ON/OFF to the load. The second actuator has a movable user operable portion that is user accessible via the unitary aperture for adjusting magnitude of power delivered to the load. The movement and position of the respective user operable portions of the first and second actuators are mutually independent.

20 Claims, 7 Drawing Sheets

ELECTRICAL DEVICE CONTROLLER HAVING A SWITCH AND A THUMBWHEEL DIMMER

BACKGROUND

The present disclosure relates generally to devices for controlling electrical loads. In particular, the present disclosure relates to an electrical device for controlling electrical loads having a switch actuator for on/off control of a load and a thumbwheel dimmer actuator for adjusting power delivered to a load.

Prior art devices may include a single actuator providing both a switch and a dimmer function. One example is a spring mounted thumbwheel actuator that acts as a dimmer when turned and acts as a switch when pushed. Another example is a thumbwheel actuator or a slide actuator that has an on-off function at the beginning or end of the sliding or rotating action associated with the dimming function.

Prior art devices may also include two side-by-side actuators, one switch actuator and one dimming actuator. However, one limitation of the prior art devices is that they require different apertures in the faceplate for each actuator. Another limitation is that at least one of the hand operable portions of the two actuators are stationary, or that movement of the hand operable portion of one of the actuators causes the other actuator to move.

SUMMARY

The present disclosure is directed to an electrical device controller for controlling power to a load. The controller includes a housing having at least one open face and a plate secured to the housing and disposed over the open face of the housing. The plate has a unitary aperture. The electrical device controller further includes at least one electrical component positioned within the housing for coupling to a power source and a load, where the at least one electrical component is a power controller, a first actuator coupled to the at least one electrical component, and a second actuator coupled to the at least one electrical component and which is adjacent to the first actuator.

The first actuator has a movable user operable portion that is user accessible via the unitary aperture of the plate, wherein movement of the user operable portion controls power ON and OFF to the load. The second actuator has a movable user operable portion that is user accessible via the unitary aperture of the plate, wherein movement of the user operable portion adjusts the magnitude of power delivered to the load. The movement and position of the respective user operable movable portions of the first and second actuators are independent of one another.

The present disclosure is also directed to another embodiment of an electrical device controller for controlling power to a load. The controller includes a housing having at least one open face and a plate secured to the housing and disposed over the open face of the housing. The plate has a unitary aperture. The electrical device controller further includes at least one electrical component positioned within the housing for coupling to a power source and a load, where the at least one electrical component is a power controller, a first actuator coupled to the at least one electrical component, and a second actuator coupled to the at least one electrical component.

The first actuator is user accessible via the unitary aperture of the plate, wherein actuation of the first actuator controls power ON and OFF to the load. The second actuator is user accessible via the unitary aperture of the plate, wherein actuation of the second actuator adjusts the magnitude of power delivered to the load. Actuation of the first actuator includes rotation of the first actuator about a first axis of rotation, and actuation of the second actuator includes rotation about a second axis of rotation which is offset from the first axis of rotation.

The present disclosure is directed to a further embodiment of an electrical device controller for controlling power to a load. The controller includes a housing having at least one open face and a plate secured to the housing and disposed over the open face of the housing. The plate has a unitary aperture. The electrical device controller further includes at least one electrical component positioned within the housing for coupling to a power source and a load, where the at least one electrical component is a power controller. The at least one electrical component includes a potentiometer for controlling the amount of power delivered to a load.

Additionally, the electrical device controller includes a first actuator coupled to the at least one electrical component and a second actuator coupled to the at least one electrical component. The first actuator is user accessible via the unitary aperture of the plate, wherein actuation of the first actuator controls power ON and OFF to the load. The second actuator is user accessible via the unitary aperture of the plate, wherein actuation of the second actuator adjusts the magnitude of power delivered to the load. The electrical device controller is further provided with a circuit board oriented perpendicular to the plate, wherein the potentiometer has a face with electrical connections for electrically coupling to the circuit board, a track, and a tab which is movable along the track for adjusting the potentiometer for controlling the power delivered.

Other features of the presently disclosed electrical device controller will become apparent from the following detailed description, taken in conjunction with the accompanying drawings, which illustrate, by way of example, the presently disclosed electrical device controller.

BRIEF DESCRIPTION OF THE DRAWINGS

Various embodiments of the present disclosure will be described below with reference to the figures, wherein.

DETAILED DESCRIPTION

Figure 1:
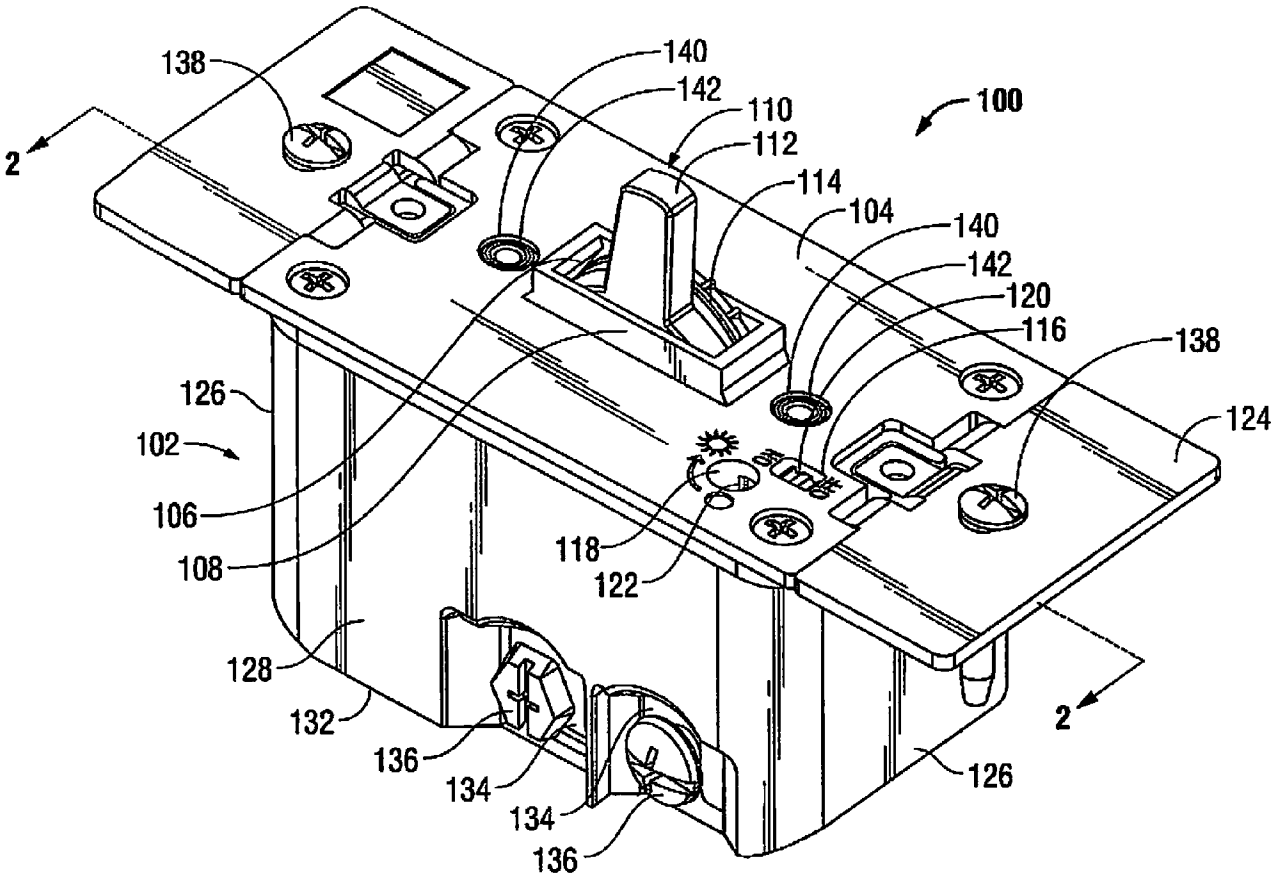
FIG. 1 is a top perspective view of an electrical device controller in accordance with the present disclosure.

Referring now to the drawing figures, in which like references numerals identify identical or corresponding elements, the electrical device controller in accordance with the present disclosure will now be described in detail. With initial reference to FIG. 1, an exemplary electrical device controller accordance with the present disclosure is illustrated and is designated generally as electrical device controller 100. The electrical device controller 100 is mounted, such as on a wall of a room, and electrically coupled to at least one electrical device, such as a lighting device or a ceiling fan, where the controlled electrical device(s) may be remote from the electrical device controller 100, e.g., positioned on the ceiling of the room.

Electrical device controller 100 includes a housing having a cup-shaped back body 102 and a front plate 104 which is positioned on top of the back body 102 when assembled, describing a cavity. The front plate 104 has an upper surface 103, a bottom surface 105 and a first aperture 106 surrounded by a frame 108 which communicates between the upper surface 103 and bottom surface 105. The back body 102 and front plate 104 are made of a nonconductive material, such as plastic and are attached to one another, such as by a fastener, e.g., a screw or mating structures for a snap fit. The first aperture 106 is a single, continuous aperture that is not partitioned into more than one aperture. Positioned within the first aperture 106 are user operable portions of a switch assembly 110 including a toggle switch 112 and a rotary wheel 114, both of which are formed of a nonconductive material, such as plastic. The toggle switch 112 and the rotary wheel 114 are both actuators which each include an upper user operable portion that is accessible from the front plate 104 for actuating the actuator, and a lower portion that extends downward and lies below the front plate 104 and interacts with other components of the electrical device controller 100.

The user operable portions of the toggle switch 112 and the rotary wheel 114 are adjacent to one another. The respective user operable portions are user accessible via the first aperture 116. There is no intervening material in between the first and second actuators that is visible when the electrical device controller is assembled. Accordingly, there is no webbing or partitioning in between the user operable portions of the toggle switch 112 and rotary wheel 114.

The switch assembly 110 provides user control of the at least one electrical device controlled by the electrical device controller 100, with the toggle switch 112 providing on-off control and the rotary wheel 114 providing dimmer control. Dimmer as used here is not limited to operating a lighting device, but may be used for controlling a variety of electrical devices by providing a variable magnitude of power to the electrical device in a graduated or incremental fashion. For example, the dimmer control may control the speed of fan or a characteristic of an appliance, such as the volume of a radio or television.

The front plate 104 is further provided with second and third apertures 116 and 118, respectively. Positioned with the second aperture 116 is an indicator switch 120 for operating an indicator, such as a neon bulb in this embodiment, which is provided within the housing and is discussed further below. The indicator switch 120 switches the neon light on and off. The light produced by the neon light provides a backlighting effect and is visible to a user, either via the first aperture 106 or a translucent portion of the front plate, such as window (not shown). When the neon light is on it provides a gentle glow that can help a user locate the electrical device controller 100 in a dark room.

Positioned within the third aperture 118 is a potentiometer setting control (PSC) 122 which allows a user to set the minimum or maximum setting controlled by the rotary wheel 114. As described further below, the rotary wheel 114 operates a potentiometer which varies the power supplied to the electrical device to which it is electrically connected. In the current example, the PSC 122 sets the minimum setting for the potentiometer, but it is envisioned that the electrical device controller 100 may be configured for the PSC 122 to set a minimum or maximum power level that the potentiometer can output. The PSC 122 may have a user accessible portion which is raised relative to the front plate 104 so that it is hand accessible to the user, or it may be recessed below the plane of the front plate 104 so that it is accessible to a user by using a tool, e.g., a screwdriver.

A user operates the user accessible portion to actuate the PSC 122 for adjusting the minimum or maximum of a range of the amount of power that can be delivered to the load. Since the PSC 122 is user accessible via the third aperture 118 of the front plate 104, the minimum or maximum of the range of power that can be delivered to the load is user adjustable while the electrical device controller 100 is mounted, e.g., to a wall. It should be noted that while the embodiment described includes a PSC 122 for setting a minimum or maximum power level, any suitable adjustable element can be used to set any suitable characteristic desired to be set.

The electrical device controller 100 is further provided with a U-shaped strap 124 which is sandwiched between the back body 102 and the front plate 104 where the fit may be tight in order that it is not necessary to screw the strap 124 to the back body 102 or the front plate 104 in order to hold it in place. The cup-shaped back body 102 has end walls 126, side walls 128 and bottom wall 132. The strap 124 fits snugly inside the back body 102 by laying against an interior surface of the end walls 126 and the bottom wall 132. Electrical components of the electrical device controller 100 are disposed within the cavity described by the back body 102, the strap 124 and the front plate 104 when the front plate 104 and back plate 102 are assembled. An upper surface of a portion of the strap 124 which is exposed when the front plate 104 is assembled to the back body 102 is flush with an upper surface of the front plate 104 (see FIG. 1), providing for a simple installation when the electrical device controller 100 is mounted, e.g., in a wall.

The "U" shaped configuration of the strap 124 allows for access from the front of the electrical device controller 100 during manufacture before the front face 104 is secured in position, e.g., for assembling the electrical components. The strap 124 is formed of a thermally conductive material, such as metal, e.g., aluminum, and conducts heat and electricity well. The "U" shape configuration of the strap 124 provides greater flexibility in terms of where to place components at the design stage, particularly heat generating components, such as a triac component described in greater detail further below, which generates the most significant amount of heat in the electrical device controller 100 and therefore is fixed to the strap 124 to allow for heat dissipation. The strap 124 becomes slightly warm during operation and the back body 102 provides heat and electrical insulation.

FIG. 1 shows that the back body 102 includes cutouts 134 to accommodate screws 136, which may include, for example, a terminal screw and a ground screw. However, it is to be understood that the use of screw terminals or electrical leads are within the scope of the present disclosure. Mounting screws 138 are provided for mounting the electrical connector device 100, e.g., to a wall and/or an electrical box in the wall.

Figure 2:
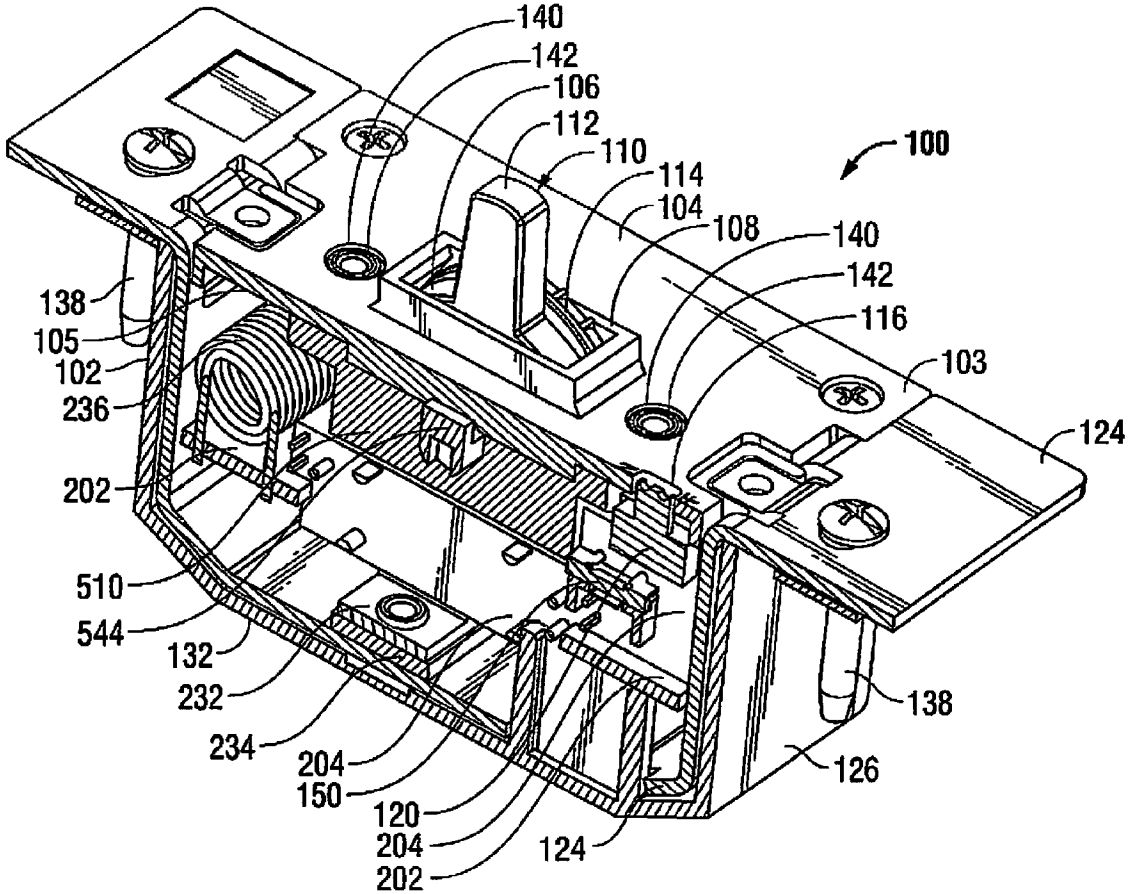
FIG. 2 is a cross section taken along line 2-2 of the electrical device controller shown in FIG. 1.
Figure 3:
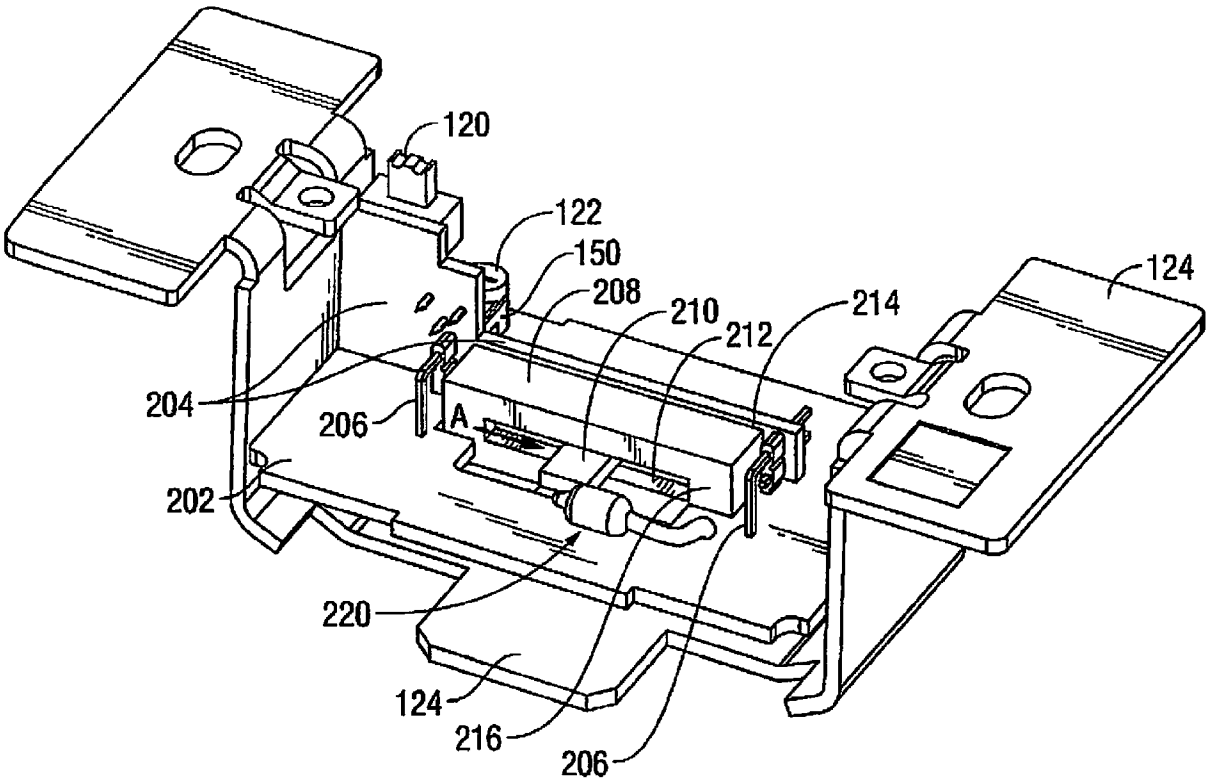
FIG. 3 is a side perspective view of a strap and circuit board configuration with coupled electrical components of an electrical device controller in accordance with the present disclosure.

With reference to FIGS. 1-3, a printed circuit board (PCB) assembly is shown having a horizontal PCB 202 which is oriented parallel to the front plate 104 and a vertical PCB 204 which is oriented at a right angle to the front plate 104. The horizontal and vertical PCBs 202 and 204 may include circuit boards other than PCBs, and are not limited to PCBs. The horizontal PCB 202 and the vertical PCB 204 are electrically coupled by right angle PCB connectors 206. The electronic components of the device are coupled to at least one of the horizontal PCB 202 and the vertical PCB 204. The vertical PCB 204 is shaped to accommodate components, such as for providing access to the potentiometer 208 for adjusting the power delivered to the load. The configuration of the horizontal PCB 202, vertical PCB 204 and electrical components coupled thereto is exemplary and other configurations are within the scope of the present disclosure.

The U-shape of the strap 124 provides additional surface area for dissipating heat. Mac 232 is coupled to the horizontal PCB 202, is positioned below an underside 230 of horizontal PCB 202 and rests on heat spreader 234, which is coupled to the strap 124. The triac 232 is a bidirectional electrical switch that conducts alternating current during positive and negative phases of each cycle. The triac 232 generates some heat. Heat generated by the triac is transferred to the heat spreader and then to the strap 124 for dissipation thereof. Additional electrical components which are included in the circuitry for providing the switching and dimming functionality, such as capacitors, resistors (not shown), neon bulb 220, and toroid 236, are coupled to at least one of the horizontal PCB 202 and vertical PCB 204. In the current example, these components are all coupled to the horizontal PCB 202.

Potentiometer 208 is coupled to the vertical PCB 204 for controlling the amount of power delivered to an electrical device being controlled, which is also referred to as a load. The potentiometer 208 is provided with a sliding tab 210, which slides back and forth along a linear sliding track 212, wherein movement of the tab 210 varies the power delivered. When the sliding tab 210 is positioned at one end of the sliding track 212, the power delivered to an electrical device being controlled by the electrical device controller 100 is at a minimum setting and when the sliding tab 210 is positioned at the other end of the sliding track 212, the power delivered to the electrical device being controlled by the electrical device controller 100 is at a maximum setting. The minimum and maximum settings can be adjusted, as described further below.

The potentiometer 208 has a connector face 214 that lies in a plane perpendicular to the plane of the front face 104, where the connector face 214 includes electrical connectors, such as pins, for connecting to the vertical PCB 204. The sliding track 212 lies on an opposing face 216 of the potentiometer 208 relative to the connector face 214. The opposing face 216 also lies in a plane perpendicular to the plane of the front face 104. The sliding tab 210 further lies in a single plane which also lies in a plane parallel to the plane of the front face 104. As described further below, the sliding tab 210 is operated by the rotary wheel 114, where rotary movement of the rotary wheel 114 causes the sliding tab 210 to move in a linear path A along the linear sliding track 212 which is parallel to the plane of the front face 104. When the sliding tab 210 is moved along the sliding track 212 the power delivered to the electrical device being controlled is gradually increased or decreased, depending on the direction that the sliding tab 210 is moved in.

Indicator switch 120 is mounted on the vertical PCB 204. The indicator switch 120 includes a movable user operable portion and an electrical switch component. The electrical switch component is electrically coupled at least via the vertical PCB 204 to the neon bulb 220 and opens and closes an electrical circuit formed between the neon bulb 220 and a current source providing current to the neon bulb 220. The electrical switch component may be further electrically coupled to the neon bulb 220 via the horizontal PCB 202 and the connectors 206. The user operable portion is formed of nonconductive material, such as a plastic, wherein user operation of the user operable portion causes the electrical switch to open and close the electrical circuit. The user operable portion is user accessible and/or extends through the second aperture 116. Operation of the user operable portion causes the neon bulb 220 to be switched on or off. The effect of switching on the neon bulb 220 is to provide backlighting, such as to aid a user to locate the electrical device controller 100 in a dark room.

Figure 4:
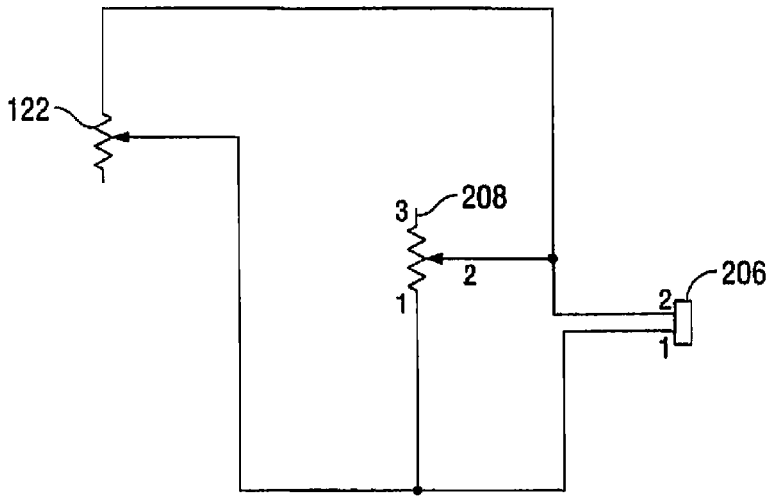
FIG. 4 is a schematic circuit diagram of a potentiometer setting control provided on a vertical circuit board of an electrical device controller in accordance with the present disclosure.
Figure 5:
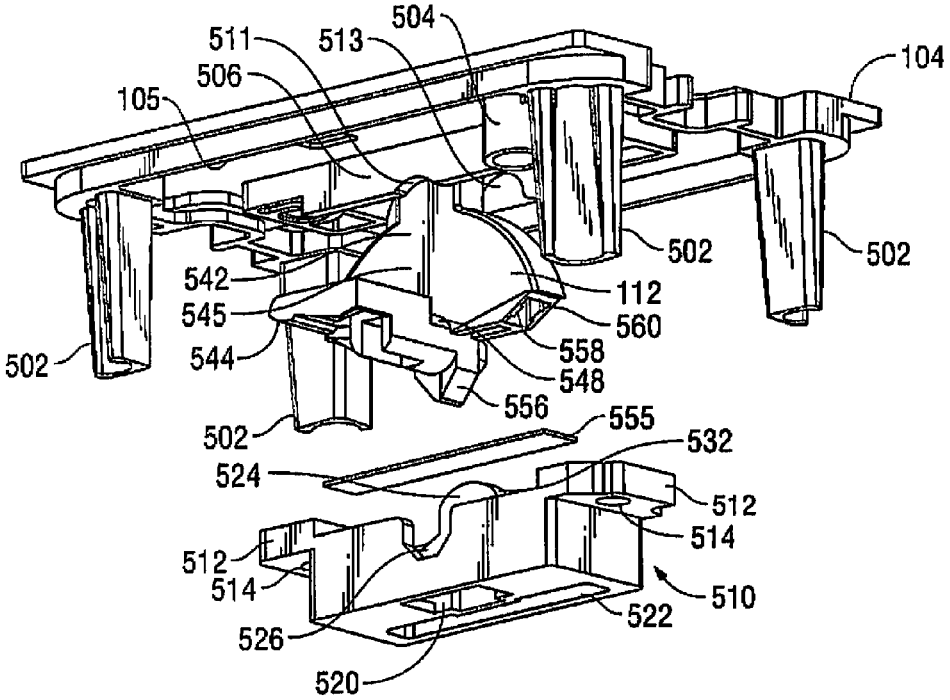
FIG. 5 bottom perspective exploded view of a front plate, toggle switch and toggle structure of an electrical device controller in accordance with the present disclosure.
Figure 6:
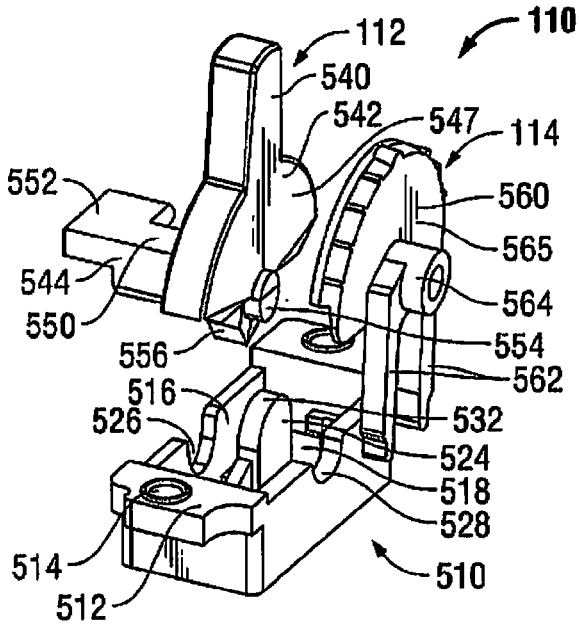
FIGS. 6 and 7 are front perspective exploded views of a switch assembly of an electrical device controller in accordance with the present disclosure.
Figure 7:
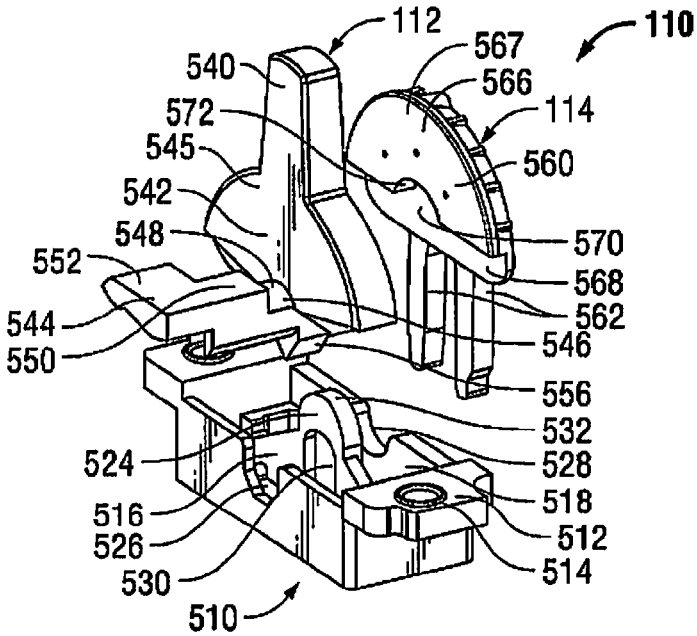

PSC 122 is supported by PSC holder 150, and is further electrically coupled to the vertical PCB 204. Via the vertical PCB 204 the PSC 122 is electrically coupled to the potentiometer 208, as shown in FIG. 4. The user operable portion of PSC 122 is user accessible through third aperture 118. The PSC 122 adjusts control circuitry in the potentiometer 208 which controls the amount of power delivered to the load based on the position of the tab 210. Adjustment of the PSC 122 adjusts the minimum or maximum of the range of power controlled by the potentiometer 208 for delivery to the load. Adjustment of the PSC 122 may further adjust the amount of power delivered to the load when the tab 210 is in a particular position. In the current example, operation of the PSC 122 sets the minimum setting that determines the minimum amount of power that the potentiometer 208 can control for delivery to the load. The circuit shown in FIG. 4 may be modified so that PSC 122 sets the maximum setting of the potentiometer 208.

The PSC 122 in the current example is a potentiometer, and in particular a screw potentiometer in which the user operable portion of the PSC 122 is rotatable and is configured with a groove for receiving a screwdriver. The user operable portion may be rotated by twisting the screwdriver while it is inserted in the groove. This operates the potentiometer of the PSC 122 to adjust the potentiometer 208 for adjusting a maximum or minimum of a range of the amount of power controlled by the potentiometer 208 for delivery to the load.

By mounting of the PSC 122 and the indicator switch 120 to the vertical PCB 204, they are accessible to the user via the front plate 104 of the electrical device controller 100. Each of the controls, PSC 122 and indicator switch 120, may extend far enough above the front plate 104 to be hand operable, or may be recessed below the corresponding aperture in the front plate 104 such that the control is only adjustable by using a tool, such as a screw driver. The PSC 122 and indicator switch 120 may each be equipped with one or more notches for receiving a tool, such as a screw driver, to operate the control. Accordingly, the potentiometer 208 may be adjusted by a user via the PSC 122 while the electrical device controller 100 is mounted, e.g., to a wall without the need to remove the controller 100 from its mounted position.

The front plate 104 is further provided with a fifth aperture 140 which communicates between the top and bottom surfaces 103 and 105 of the front plate 104. The fifth aperture 140 receives a fastener 142. As described further below, the fastener 142 fastens a toggle structure of the switch assembly 110 to the front plate 104. The toggle structure engages the toggle switch 112 and rotary wheel 114.

The front plate 104, the switch assembly 110, and their interaction are described in greater detail with respect to FIGS. 5-8. The bottom surface 105 of front plate 104 is provided with arms 502 which fit snugly between the back body 102 and the strap 124 for obtaining a secure and stable fit between the back body 102, the front plate 104, and the strap 124. A semi circular cylindrical guide 504 extends from the fourth aperture 118 for accommodating the PSC 122.

The frame 108 of the front plate 104 includes a lower portion 506 which extends from the bottom surface 105 of front plate 104. The portion of the frame 108 which extends above the upper surface 103 of the front plate 104 may be continuous with the lower portion 506 forming a single wall, or may be discontinuous, such that a first wall forms the top portion of the frame 108 and a second wall forms the lower portion 506.

In the current example, two end walls and one side wall of the portion of the frame 108 which extends above the upper surface 103 of the front plate 104 is continuous with the lower portion 506. The other side wall of the frame 108 is discontinuous with the lower portion 506. Both side walls of the frame 108, including the lower portion 506, are vertical. Both end walls of the frame 108, including the lower portion 506, are angled so that the first aperture 106 is shorter in length at the top of frame 108 than at the bottom, which accommodates the shape of the toggle switch 112 and rotary wheel 114 for a snug fit. The sidewalls of lower portion 506 are provided with first and second asymmetrical substantially semicircular cutouts 511 and 513.

The switch assembly 110 includes a toggle structure 510 which is coupled to the bottom surface 105 of front plate 104 by fastener 142. (In addition, see FIG. 1.) Fastener 142 may be a temporary fastener, such as a screw or a permanent fastener, such as an eyelet or grommet. The toggle structure 510 lies completely below the front plate 104 and is not visible when the front plate 104 is placed in its position. The toggle structure 510 includes winged portions 512 at each of its ends in which there are apertures 514 for receiving fastener 142. A first compartment 516 and second compartment 518 are formed in toggle structure 510 for receiving the toggle switch 112 and the rotary wheel 114, respectively. The bottom wall of compartment 516 is provided with an opening 520. The opening 520 provides extra room for deflection of the center portion of metal spring 555, and the bottom wall of compartment 518 is provide with an opening 522 through which an arm portion of the rotary wheel 114 (described further below) extends.

The toggle structure 510 includes a partition 524 positioned between the first and second compartments 516 and 518. The partition 524 is shaped to be adjacent to the toggle switch 112 and the rotary wheel 114 and to facilitate the movement of each of the toggle switch 112 and rotary wheel 114 during actuation thereof. In one embodiment, the partition 524 at least partially supports the toggle switch 112. The outer side wall of the first compartment 516 is provided with a first cutout 526 and the outer side wall of the second compartment 518 is provided with a second cutout 528 having a rounded shape. The partition 524 is provided with a curved indentation 530 and has a curved upper surface 532. The first and second cutouts 526 and 528 of the toggle structure 510's outer side walls and the curved indentation 530 of the partition 524 is adjacent to the toggle switch 112 and rotary wheel 114 for facilitating rotation of each of the toggle switch 112 and the rotary wheel 114 about different axes of rotation, which is described in greater detail below. In one embodiment the cutout 526 at least partially supports the toggle switch 112. Furthermore, in one embodiment at least one of the upper surface 532 of partition 524 and cutout 528 at least partially support the rotary wheel 114. In other embodiments it is not necessary to have the two cutouts. Furthermore, in other embodiments, it is not necessary for the cutouts to at least partially support the toggle switch and/or the rotary wheel.

The toggle switch 112 is a monolithic component formed of a single piece of nonconductive material, such as plastic. The present disclosure is not limited thereto, and the toggle switch 112 could be formed of two or more parts that are attached to one another. The toggle switch 112 includes a handle 540 that extends above the upper surface 103 of the front plate 104 which can be grasped by a user and moved between a first position for turning on the load and a second position for turning off the load. The handle 540 extends from a base 542 having a generally semicircular shape which is seated in the toggle structure 510 and received within the frame 108. An arm 544 extends from the base 542 on an exterior face 545 of the toggle switch 112. The arm 544 is attached at a first end 546 to the base 542 by a shaft 548 which is received and engaged within cutout 526 of the toggle structure 510. The atm 544 includes an L portion having a first leg 550 which extends from the shaft 548 and a second leg 552 which extends substantially at a right angle to the first leg 550.

A generally circular knob 554 having substantially the same diameter as the shaft 548 is provided opposite the arm 544 on an interior face 547 of the toggle switch 112. The knob 554 is received within indentation 530 of the partition 524. Knob 554 may snap fit within indention 530 to facilitate assembly. The centers of the shaft 548 and the knob 554 are aligned such that a line passing through the two centers is an axis of rotation of the toggle switch 112 when the toggle switch 112 is activated by user (with aid from the flat spring 555) by moving the handle 540 between the first and second positions.

In the present example, the shaft 548 fits within cutout 526 which rotatably engages the toggle switch 112 in the toggle structure 510. The indentation 530 has a curved upper surface which guides the upper surface of knob 554 as the toggle switch 112 is moved between positions and stabilizes the toggle switch 112 within the toggle structure 510. When the toggle structure 510 is mounted to the front plate 104, cutout 526 of the toggle structure 510 mates with cutout 511 of the front plate 104 for receiving and securely holding shaft 548 while facilitating rotation of the arm 544 as the handle 540 is moved between positions. In one embodiment the arm 544 is at least partially stabilized by the cutout 526 and the cutout 511 when the toggle structure 510 is mounted to the front plate 104. Since the cutouts 511 and 526 hold the shaft 548 in its place it is the location of the cutouts 511 and 526 which determine the position of the axis of rotation of the toggle switch 112 as the handle 540 is moved between positions. This is because the axis of rotation of the toggle switch 112 is the center of the shaft 548 whose position is decided by the position of the cutouts 511 and 526.

The second leg 552 acts as a lever which moves up and down as the handle 540 is moved between positions. When the second leg 552 (also referred to as lever 552) is in a down position it contacts an electrical component that causes power to flow through circuitry of the electrical device controller 100 so that power is provided to the load. When the lever 552 is in an up position it does not contact the electrical component, which causes a break in the circuitry of the electrical device controller 100 so that power is not provided to the load. In the present example the electrical component is a switching device that opens and breaks a circuit.

When the toggle switch 112 is assembled a flat spring 555 is placed inside the compartment 516 and lies on ribs provided on the floor of the compartment 516. The toggle switch 112 is placed in the compartment 516 of the toggle structure 510 and the shaft 548 of the arm 544 fits into cutout 526. The bottom of the base 542 is provided with a pointed projection 556 which impacts upon the flat spring 555 as the handle 540 is moved between positions. The flat spring 555 is formed of a resilient material, (which is metal in the current example, but is not limited thereto), which is biased to apply a force to the pointed projection 556, causing the handle 540 to spring into its first or second position when a mild force is applied to the handle 540 in a direction that corresponds to the respective position. Rubber feet (not shown) may be mounted to opposing ends 558 of the base 542 which cushions the end 558 of the base 542 as it lands on the flat spring 555 due to the spring action of the toggle switch 112 caused by the flat spring 555 and cooperating projection 556. The ends 558 may include a mounting structure 560 which mates with a mounting structure on the rubber foot for mounting the rubber foot.

The rotary wheel 114 is a monolithic component formed of a single piece of nonconductive material, such as plastic. The present disclosure is not limited thereto, and the rotary wheel 114 may be formed of two or more parts that are attached to one another. The rotary wheel 114 includes a generally semicircular body or wheel 560 and a pair of arms 562 which extend downwards from a generally circular knob 564 coupled to an exterior face 565 of the body 560. A portion of interior face 567 of the body of the wheel 560 is removed so that the interior face 567 includes a protruding upper generally semicircular annular ring 566 and a recessed wall 568. A generally semicircular indentation 570 is formed which is backed by the recessed wall 568. The indentation 570 has an inside wall 572.

The rotary wheel 114 is received within the toggle structure 510 with knob 564 resting on cutout 528 and the inside wall 572 of indentation 570 resting on the upper surface 532 of partition 524 for rotatably engaging the rotary wheel 114. When the electrical device controller 100 is assembled and the toggle structure 510 is coupled to the front plate 104, the body 560 extends through the frame 108 with a portion of the body 560 emerging above top of the frame 108. Cutout 528 of the toggle structure 510 mates with cutout 513 of the front plate to form a generally circular hole in which knob 564 is received and held securely while facilitating rotation of the knob 564 within the hole.

The cutout 528, which engages the knob 564, determines the position of the axis of rotation of the rotary wheel 114 as the rotary wheel 114 is actuated by user by rotating the wheel 556. The axis of rotation of the rotary wheel 114 is the center of the knob 564 whose position is decided by the position of the cutout 528. A top surface of the wheel 560 which is exposed to the user is provided with ribs 576 for providing aid to the user in actuating the rotary wheel 114. A center rib 578 which is larger than the other ribs 576 signals to the user, visually and tactilely, a middle location of the wheel 560.

Figure 8:
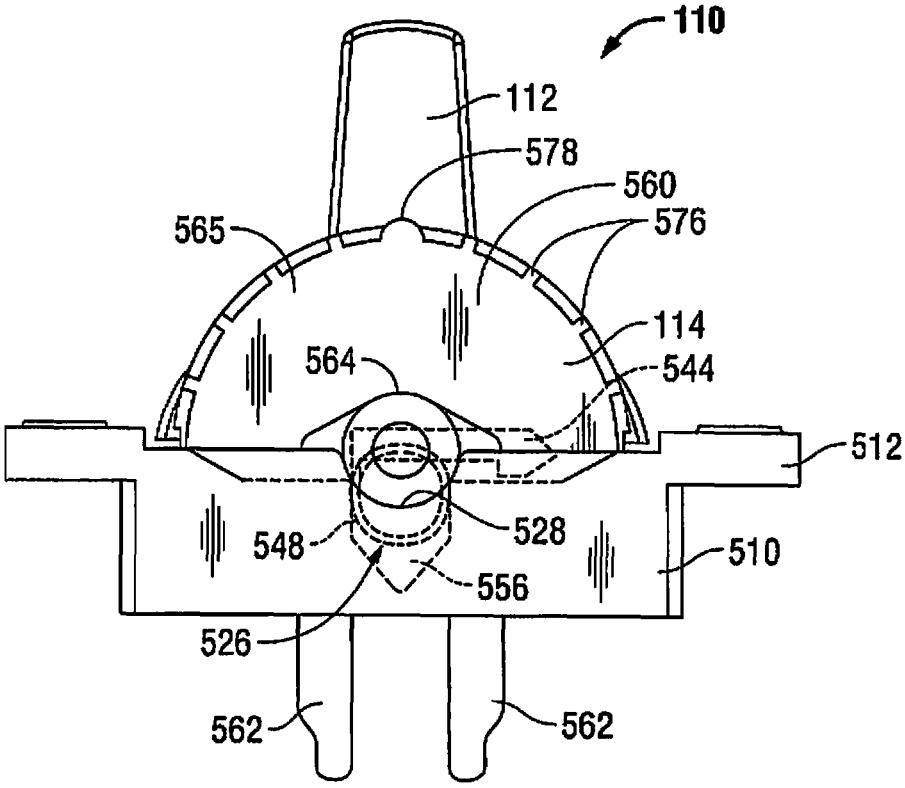
FIG. 8 is a side view of the switch assembly shown in FIG. 6 as assembled, with the toggle switch shown in phantom.

As stated above, the cutouts 511 and 526 which engage the shaft 548 and thus determine the axis of rotation of the toggle switch 112, and the cutout 528 engages the knob 564 and thus determines the axis of rotation of the rotary wheel 114. As seen in FIG. 8, cutouts 526 and 528 are asymmetric, with cutout 526 positioned lower than cutout 528. This causes a center of shaft 548 when engaged by cutout 526 to be positioned lower than a center of knob 564 when engaged by cutout 528. Accordingly, the axis of rotation of the toggle switch 112 is lower than the axis of rotation of the rotary wheel 114.

The described structures of the toggle structure 510, the toggle switch 112 and the rotary wheel 114 are exemplary and the disclosure is not limited thereto. Other structures could be used for engaging the toggle switch 112 and the rotary wheel 114 within the toggle structure 510 which allow for rotation of toggle switch 112 and rotary wheel 114 about different axes of rotation. For example, the toggle structure 510 may be provided with a round knob that is received within a rounded recess of the toggle switch 112 for allowing the toggle switch 112 to rotate about the round knob. Similar structures could be provided for the rotary wheel 114 such that the toggle switch 112 and the rotary wheel 114 having different axes of rotation.

By providing the rotary wheel 114 with an axis of rotation that is higher than the axis of rotation of the toggle switch 112, the user operable portion of the rotary wheel 114 is raised higher than it would be if the rotary wheel 114 had the same axis of rotation as the toggle switch 112. Therefore, the diameter of the rotary wheel 114 may be minimized. This is true, because if the axis of rotation of the rotary wheel 114 were lower, such as if it were as low as the axis of rotation of the toggle switch 112, the diameter of the rotary wheel 114 would have to be increased in order for a sufficient portion of the rotary wheel 114 to be exposed above the front plate 104 in order that the exposed portion be sufficiently raised above the top surface 103 of the front plate 104 to be easily hand operable by a user.

Minimization of the diameter of the rotary wheel 114 enables minimization of the size of the toggle structure 510, the aperture 106, and the frame 108, since all of the above are sized to accommodate the rotary wheel 114 and the toggle switch 112. Minimization of the toggle structure 510, the aperture 106, and the frame 108 is beneficial due to the constraints of fitting all of the electrical and mechanical components in the space defined by the back body 102. The size of the back body 102 may be limited to a standardized size or to a space allotted to it in the location where it to be mounted.

Figure 9:
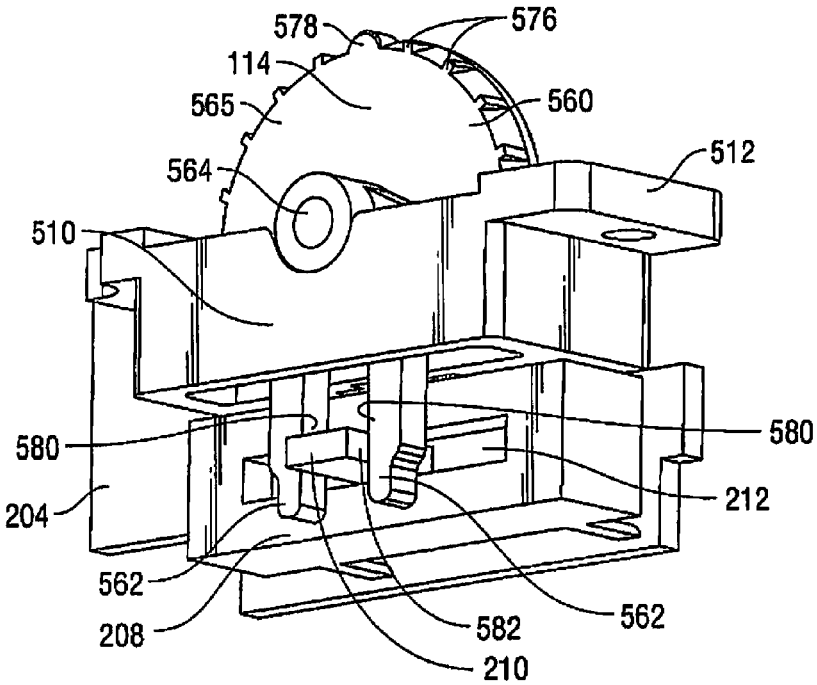
FIG. 9 is a side perspective view of a rotary wheel engaging a sliding tab of a potentiometer mounted on a vertical circuit board of the circuit board configuration shown in FIG. 3.
Figure 10:
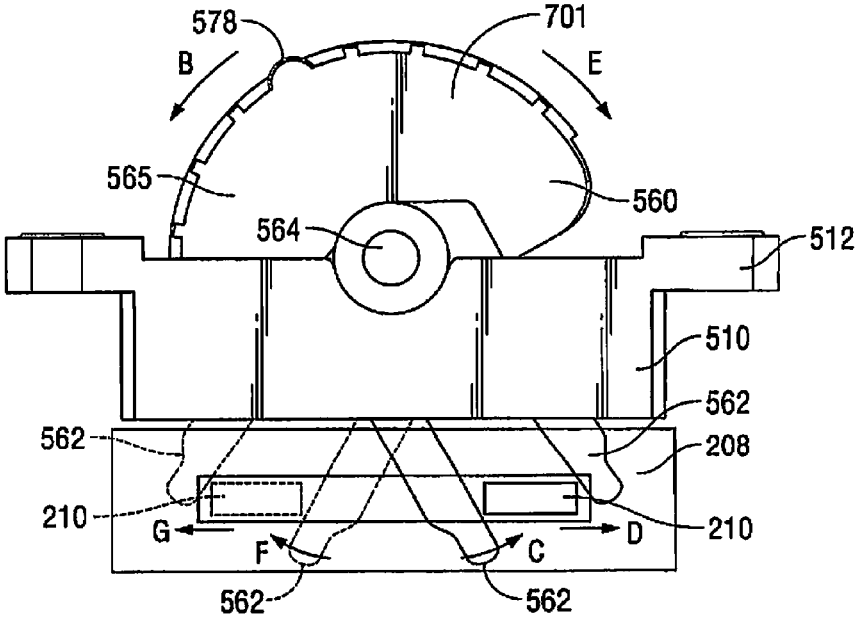
FIG. 10 is a side view of the rotary wheel shown in FIG. 9 which shows end positions of the rotary wheel when actuated.

FIG. 9 shows that the potentiometer 208 is mounted on the vertical PCB 204 so that its tab 210 is perpendicular to the arms 562 of the rotary wheel 114 and so that it is positioned between the arms 562. Inner faces 580 of the arms 562 engage the tab 210 by contacting opposing side faces 582 of tab 210. As shown in FIG. 10, as the rotary wheel 114 is actuated by a user and rotated in a first direction B, arms 562 swing upwards in an arcuate fashion in the opposite direction C. The movement of arms 562 moves the tab 210 horizontally in a linear path along the linear sliding track 212 in direction D. Accordingly, the rotary motion of the rotary wheel 114 is translated into linear movement of tab 210.

The solid lines in FIG. 10 show the arms 562 and tab 210 at a first end position, and the dotted lines show the arms 562 and tab 210 at a second end position after the rotary wheel 114 has been rotated in a second direction E. When the rotary wheel is rotated in direction E, the aims 562 swing in an arcuate fashion in direction F, pushing tab 210 so that it slides horizontally in a linear path along the sliding track 212 in direction G. When the arms 562 are swung to the first end position, the tab 210 of the potentiometer 208 is pushed to one end of the sliding track 212, and when the arms 562 are swung to the second end position, the tab 210 is pushed to the opposite end of the track 212. In the example shown, when rotating the arms 562 from the first end position to the second position the aims 562 rotate through an angle of 56 degrees, however the disclosure is not limited thereto, and other ranges of motion of the arms 562 are envisioned.

In the present example, the electrical device controller 100 includes first and second actuators, the toggle switch 112 and the rotary wheel 114, which control a single lighting device, with the toggle switch 112 controlling on-off of the power delivered to the lighting device, and the rotary wheel 114 controlling the amount of power delivered to the lighting device when it is on. The present disclosure is not limited to two actuators or controlling one electrical device. For example, the first and second actuators may control two different electrical devices of one electrical appliance, such as where the toggle switch 112 controls the light portion of a ceiling fan and the rotary wheel 114 controls the speed of the fan, with the lowest setting of the rotary wheel 114 controlling the fan to stop. The first and second actuators may control two different electrical appliances, such as two different lighting appliances, with each appliance having independent electrical connections which are separately installed.

Furthermore, the electrical device controller 100 may include more than two actuators, with each rotary wheel coupled to a different potentiometer, and each toggle switch 112 coupled to a different electrical switch. For example, the electrical device controller 100 may include first and second toggle switches 112 for control on-off of the light and fan, respectively, of a ceiling fan, and first and second rotary wheels 114 for controlling the amount of power delivered to each of the light and the fan when in activated.

Although the present disclosure has been described in accordance with the embodiments shown, one of ordinary skill in the art will readily recognize that there could be variations to the embodiment and these variations would be within the spirit and scope of the present disclosure. Accordingly, many modifications may be made by one of ordinary skill in the art without departing from the spirit and scope of the appended claims.

What is claimed is:

1. An electrical device controller for controlling power to a load, the controller comprising:

a housing including a face, the face having an aperture;

an electrical component at least partially disposed within the housing, the electrical component being adapted and configured for selectively coupling a power source to a load;

a first actuator coupled to the electrical component, the first actuator extending through and being user operable via the aperture, wherein actuation of the first actuator includes rotation about a first axis of rotation and causes the electrical component to selectively switch power ON and OFF to the load; and a second actuator coupled to the electrical component, the second actuator extending through and being user operable via the aperture, wherein actuation of the second actuator includes rotation about a second axis of rotation and causes the electrical component to adjust the magnitude of power delivered to the load;

wherein the first and second axes are offset.

2. The electrical device controller of claim 1, wherein the movement and position of the first and second actuators are independent of one another.

3. The electrical device controller of claim 1, wherein at least a portion of the face comprises a plate.

4. The electrical device controller of claim 1, wherein the first actuator includes a toggle lever.

5. The electrical device controller of claim 1, wherein the second actuator includes at least a portion of a rotary wheel which is user accessible via the aperture.

6. An electrical device controller for controlling power to a plurality of loads, the controller comprising:

a housing including a face, the face having an aperture;

an electrical component at least partially disposed within the housing, the electrical component being adapted and configured for selectively coupling a power source to each of the plurality of loads;

a first actuator coupled to the electrical component, the first actuator extending through and being user operable via the aperture, wherein actuation of the first actuator includes rotation about a first axis of rotation and causes the electrical component to selectively couple power to a first of the plurality of loads; and a second actuator coupled to the electrical component, the second actuator extending through and being user operable via the aperture, wherein actuation of the second actuator includes rotation about a second axis of rotation and causes the electrical component to selectively couple power to a second of the plurality of loads;

wherein the first and second axes are offset.

7. The electrical device controller of claim 6, wherein at least a portion of the face comprises a plate.

8. The electrical device controller of claim 6, wherein the movement and position of the first and second actuators are independent of one another.

9. The electrical device controller of claim 6, wherein the first actuator includes a toggle lever.

10. The electrical device controller of claim 6, wherein the second actuator includes at least a portion of a rotary wheel which is user accessible via the aperture.

11. The electrical device controller of claim 6, wherein at least one of the first and second actuators causes the electrical component to adjust the magnitude of power delivered to at least one of the first and second of the plurality of loads.

12. An electrical device controller for controlling power to a load, the controller comprising:

a housing including a front surface having an exterior face, an interior face, and an aperture;

an electrical component at least partially disposed within the housing, the electrical component being adapted and configured for selectively coupling a power source to a load;

a first actuator coupled to the electrical component, the first actuator extending through and being user operable via the aperture, wherein actuation of the first actuator includes rotation about a first axis of rotation and causes the electrical component to selectively switch power ON and OFF to the load;

a second actuator coupled to the electrical component, the second actuator extending through and being user operable via the aperture, wherein actuation of the second actuator includes rotation about a second axis of rotation and causes the electrical component to adjust the magnitude of power delivered to the load; and an actuator support structure disposed at least partially within the housing, the actuator support structure comprising first and second substructures, the first and second substructures being adapted and configured to rotatably engage the first and second actuators, respectively, wherein the actuator support structure is coupled to the interior face of the front surface.

13. The electrical device controller of claim 12, wherein at least a portion of the front surface comprises a plate.

14. The electrical device controller of claim 12, wherein the movement and position of the first and second actuators are independent of one another.

15. The electrical device controller of claim 13, the actuator support structure including a support coupling structure, the interior face including face coupling structure, wherein the support coupling structure and the face coupling structure are configured to cooperatively couple the actuator support structure to the interior face of the front surface.

16. The electrical device controller of claim 15, the support coupling structure including at least one aperture and the face coupling structure including at least one aperture, wherein the support coupling structure aperture and the face coupling aperture are aligned and configured to receive a fastener through both of said apertures.

17. The electrical device controller of claim 13, wherein the first and second substructures rotatably engage the first and second actuators such that the first and second actuators are substantially adjacent to each other.

18. The electrical device controller of claim 13, wherein the first actuator is a toggle switch comprising a handle extending through the aperture, a base having a generally semicircular shape configured for being supported by the actuator support structure.

19. The electrical device controller of claim 13, wherein the first actuator comprises a shaft and at least one leg extending from the shaft.

20. The electrical device controller of claim 13, wherein the second actuator is a rotary wheel comprising a semicircular body, and wherein said rotary wheel is at least partially supported by the second substructure of the actuator support structure.

* * * * *